United States Patent [19]

Kobayashi

[11] Patent Number: 5,027,156

[45] Date of Patent: Jun. 25, 1991

[54] SEAL STRUCTURE FOR A CHAMBER MEANS CONTAINING A DEVELOPER MATERIAL

[75] Inventor: Masahiko Kobayashi, Yamatotakada, Japan

[73] Assignee: Mita Industrial Co., Ltd., Osaka, Japan

[21] Appl. No.: 393,195

[22] Filed: Aug. 14, 1989

[30] Foreign Application Priority Data

Aug. 26, 1988 [JP] Japan ..... 63-213248

[51] Int. Cl.[5] ..... G03G 15/06

[52] U.S. Cl. ..... 355/245; 118/653; 222/DIG. 1; 355/260

[58] Field of Search ..... 355/215, 260, 245; 118/653, 657, 658; 222/541, 544, DIG. 1; 206/631, 633

[56] References Cited

U.S. PATENT DOCUMENTS

| | | | |
|---|---|---|---|
| 3,999,654 | 12/1976 | Pollack | 222/DIG. 1 X |
| 4,589,579 | 5/1986 | Morita | 222/DIG. 1 X |
| 4,615,608 | 10/1986 | Mizutani | 118/658 X |
| 4,650,070 | 3/1987 | Oka et al. | 222/DIG. 1 X |
| 4,862,210 | 8/1989 | Woolley | 355/260 X |
| 4,895,104 | 1/1990 | Yoshino et al. | 118/653 |
| 4,931,838 | 6/1990 | Ban et al. | 355/260 |

*Primary Examiner*—A. T. Grimley
*Assistant Examiner*—William J. Royer
*Attorney, Agent, or Firm*—Jordan and Hamburg

[57] ABSTRACT

A seal structure including a seal member for sealing a developer chamber with unused developer accommodated in the chamber. The seal member partly extends outward from the chamber to provide a pull portion and is removable from the chamber by pulling the pull portion. In one embodiment, the seal member is folded over at an intermediate portion thereof to form a folded portion over the pull portion, the folded portion being secured to the body of the developing device and formed in an edge thereof with a tear portion for separating the seal member into an end portion positioned inside the device and the other portion when the seal member is pulled. In another embodiment, the developer chamber is externally provided with a seal holder permitting insertion of the seal member. In another embodiment, the pull portion has an inwardly recessed contour extending from the outer end thereof to at least one side edge of the seal member.

39 Claims, 9 Drawing Sheets

SEAL STRUCTURE FOR A CHAMBER MEANS CONTAINING A DEVELOPER MATERIAL

BACKGROUND OF THE INVENTION AND RELATED ART STATEMENT

The present invention relates to a seal structure for hermetically enclosing the developer or toner for use in the developing device incorporated in image forming apparatus such as copying machines and facsimile systems before the device is placed into use.

The developing devices installed in such image forming apparatus are sometimes filled with unused developer or toner (herein referred to collectively as "developer") in advance. The developer accommodated in the device must be sealed off so as not to deteriorate before use. Generally, the developing device is internally provided with a developer chamber, and the opening of the developer chamber is closed, for example, with a film-like seal member to hermetically enclose the developer therein. With some developing devices, the developer chamber is in the form of a cartridge removably attached to the device, and the opening of the cartridge is similarly closed with a seal member. In the case where the developer is thus hermetically accommodated within the developing device, the seal member is pulled out from outside the device immediately before use.

However, since the periphery of the seal member is affixed, over the entire width thereof (transverse to the developing device), to the housing of the device, it is difficult to remove the seal member even if it is pulled in a direction perpendicular to the widthwise direction. The seal member is effectively removable when pulled obliquely. With reference to FIG. 9 showing a conventional method of removing a seal member 102 from a developing device 101, it is difficult to remove the seal member 102 by pulling the member longitudinally of the device (in the direction of arrow X). It has been found that the seal member 102 can be removed gradually from one end thereof with a relatively small force by pulling the member in an oblique direction (the direction of arrow Xl) containing a component of the longitudinal direction and a component of the transverse direction with respect to the developing device.

Nevertheless, when the seal member 102 is pulled in this way, the following troubles will result.

(1) The pulling direction in which the seal member is easily removable, although recognized by the manufacturer, is not known to the user who actually handles the seal member, so that the seal member is not always removable easily. Further it is cumbersome to make reference to the instruction book or rely on the serviceman for the removal of the seal member.

(2) When the seal member 102 is pulled, the end portion thereof not positioned at the center of pull (the end positioned inside the developing device 101) is subjected to almost none of the pulling force but is in a free state, so that the seal member is liable to crease inside the developing device when pulled. The developer is likely to spill from the device if the seal member 102 is pulled out in its entirety with a portion of the developer held between such creases.

(3) Since the seal member 102 is pulled aside obliquely, the member becomes slack at its edge portion on the pulled side as seen in FIG. 9. It is then likely that the slack portion will be caught by some other part, making it difficult to pull out the seal member or breaking the member.

(4) To be smoothly removable, the seal member 102 preferably has an elongated leading portion (to be grasped by the hand) extending outward from the developing device 101, whereas the leading portion, if elongated, becomes an obstacle when the device 101 is to be set in the image forming apparatus and is likely to become easily caught by some parts of the apparatus. The leading portion may be folded, but the above drawback can not be overcome unless the folded portion is entirely fastened, for example, to an outside portion of the developing device with a specific elaborate means. Moreover, the folded portion must be separated off the device by a cumbersome procedure when the seal member is to be removed.

(5) To be readily removable, the seal member 102 is generally folded at an intermediate portion, therefore consists of the folded portion and the other portion to be pulled (pull portion) and is installed inside the developing device with the pull portion only extending outward from the device. When the developing device is adapted for use with a two-component developer and has in its interior a developer compartment and a toner compartment which are closed with the single seal member 102 with developer and toner accommodated in the respective compartments, the forward end of the pull portion is likely to be caught by a developer scraper inside the device or by the partition between the two compartments to result in a break of the member.

SUMMARY OF THE INVENTION

The main object of the present invention is to overcome the foregoing problems and to provide a seal structure for developing devices which comprises a seal member affixed to the device and removable therefrom free of trouble.

The present invention provides a seal structure for a developing device having a developer chamber, the seal structure comprising a seal member for sealing the developer chamber with an unused developer accommodated therein, the seal member partly extending outward from the developing device to provide a pull portion and being removable from the developing device by pulling the pull portion. The seal structure further comprises an instruction member provided externally of the developing device for indicating the direction in which the seal member is to be pulled. With this structure, the user can readily recognize the proper direction in which the seal member is to be pulled, with reference to the instruction member.

The instruction member indicates the direction at a position approximately in coincidence with the actual position of the pull portion of the seal member, thereby showing the direction apparently for the user to recognize the proper pulling direction with greater ease.

According to the invention, the seal member is folded over at an intermediate portion thereof to form a folded portion over the pull portion. The folded portion is secured to the body of the developing device and formed in an edge thereof with a tear portion for separating the seal member into an end portion positioned inside the developing device and the other portion when the seal member is pulled. Thus, when pulled, the seal member is torn apart at the tear portion and thereby separated into an end portion positioned inside the developing device and the other portion, so that the end portion is not removed along with the other portion.

Accordingly, the end portion which is inherently liable to crease is separated off at the tear portion, permitting the other portion only to be removed from the device with a reduced likelihood of creasing. This obviates the drawback of the prior art that a portion of developer will be carried out as held between creases to spill from the developing device.

Further according to the invention, the body of the developing device is externally provided with a seal holder permitting insertion of the seal member. The pull portion of the seal member is folded over at an intermediate part thereof and has its folded part inserted in the seal holder, with the forward end of the pull portion secured to an outer portion of the developing device. Thus, the pull portion has its intermediate part held by the seal holder and is therefore less likely to be caught by some other part even if the forward end thereof only is secured. The seal member as withdrawn from the seal holder is pulled by grasping the pull portion and is accordingly removable with ease. Despite the simple structure, therefore, the pull portion is precluded from interfering with some parts when the developing device is to be set in the image forming apparatus. Moreover, the pull portion is grasped as stretched, so that the seal member can be pulled easily.

Further according to the invention, the pull portion has an inwardly recessed contour extending from the outer end thereof to at least one side edge of the seal member. When pulled obliquely toward the recessed side, the seal member thus shaped is less prone to slack since the pulled side remains planar. Consequently, the seal member is smoothly removable.

The present invention further provides a seal structure for a developing device having a starting developer compartment and a toner compartment, the seal structure comprising a single seal member for sealing the developer compartment and the toner compartment with an unused developer and an unused toner accommodated in the respective compartments, the seal member partly extending outward from the developing device to provide a pull portion and being removable from the developing device by pulling the pull portion. The seal member is folded over at an intermediate portion thereof to form a folded portion over the pull portion. The folded portion is secured to the body of the developing device. The pull portion has one end positioned, over the entire width of the seal member, toward the pull side of the seal member beyond the boundary between the two compartments. The end of the seal member pull portion is positioned toward the pull side beyond the boundary between the developer compartment and the toner compartment and therefore will not be caught by the developer scraper or the like during the removal of the seal member. This renders the seal member smoothly removable.

The above and other objects, features and advantages of the present invention will become apparent from a reading of the following detailed description and the drawings.

BRIEF DESCRIPTION OF THE DRAWINGS

FIG. 2 (*b*) is a plan view of a conventional seal member;

FIG. 3 (*b*) is a bottom view of the same;

DESCRIPTION OF THE PREFERRED EMBODIMENTS

Figure 1:
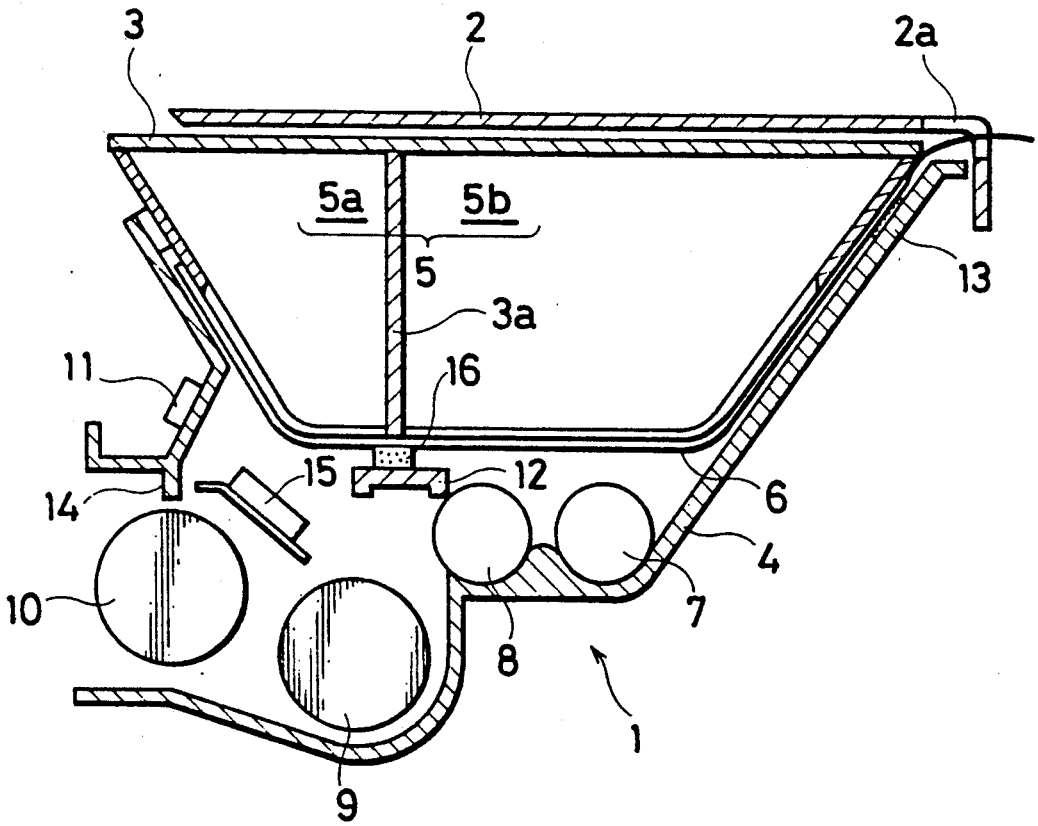
FIG. 1 is a sectional view of a developing device embodying the invention.

FIG. 1 shows the overall construction of a developing device embodying the invention.

The illustrated developing device 1 is incorporated into a process unit including a cleaner, photosensitive drum, etc. and accommodated in a housing (hereinafter referred to as "PU housing") 2. The developing device 1 has an upper housing 3 and a lower housing 4. The upper housing 3 forms a developer chamber 5 having a lower opening.

The developer chamber 5 is divided into a starting developer compartment 5*a* and a toner compartment 5*b* by an intermediate partition plate 3*a*. The developer compartment 5*a* contains an unused developer (starting developer) composed of toner and carrier admixed therewith, while the toner compartment 5*b* contains unused toner. A seal member 6 (to be described in detail later) is provided for sealing both the compartments 5*a*, 5*b* with the developer and the toner accommodated therein.

Arranged below the seal member 6 are a toner feed roller 7, toner replenishing roller 8, developer agitating roller 9 and developing roller 10. A toner control sensor 11 disposed above the developing roller 10 detects the mixing ratio between the toner and the carrier within the developing device 1.

The toner replenishing roller 8, which is positioned generally under the partition plate 3*a*, is lightly in contact with a partition member 12 disposed inside the developing device 1 and with the inner surface of the lower housing 4 to separate the interior of the device into right and left portions. The replenishing roller 8 is driven in operative relation with the toner feed roller 7 while being controlled in accordance with the output of the toner control sensor 11. The developer to be supplied to the developing roller 10 is replenished with the toner by the operation of these rollers 8, 7 and is thereby maintained at a specified toner concentration.

FIG. 1 further shows a bristle regulating plate 14 for cutting off the bristles of developer on the developing roller 10, and a developer scraper 15.

Figure 2A:
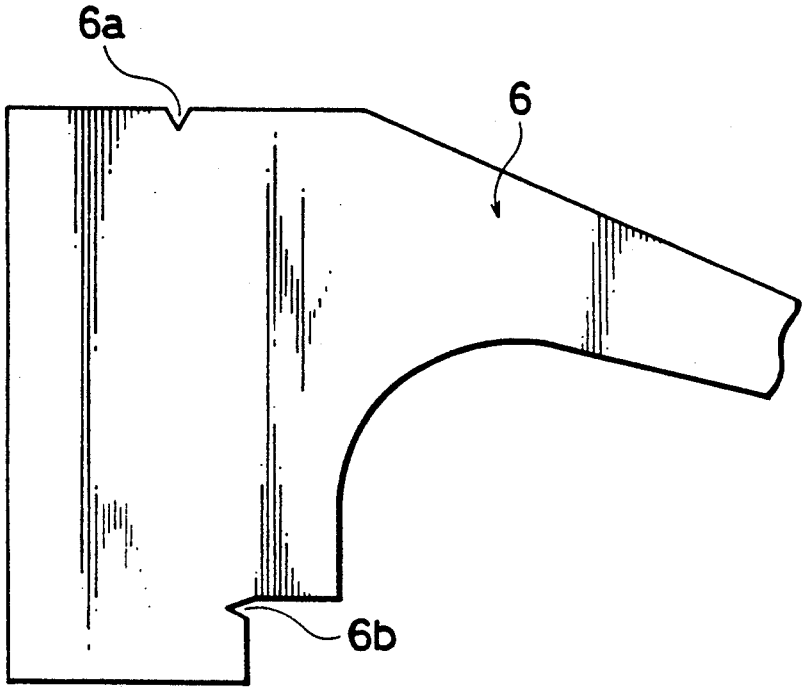
FIG. 2 (*a*) is a plan view of a seal member provided for the developing device.
Figure 2B:
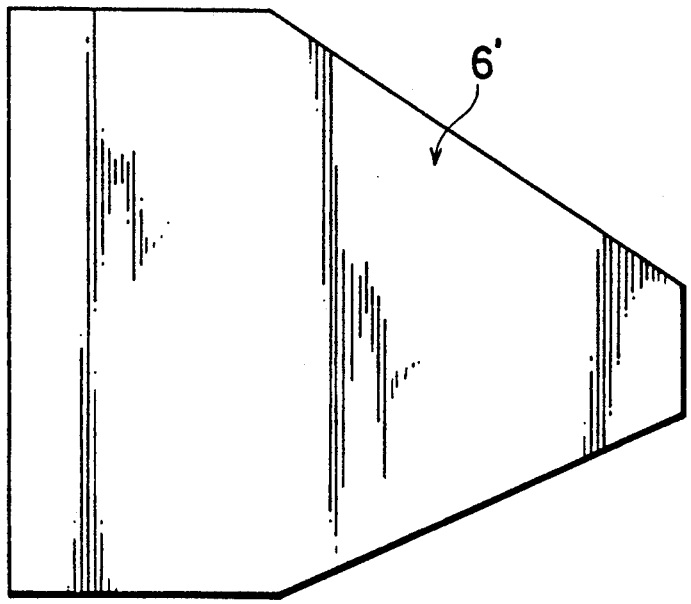
FIG. 2(b) PRIOR ART

The seal member 6 provides the seal structure to be described next with reference to FIGS. 2 to 6. The seal member 6 of the present embodiment is so shaped as shown in FIG. 2 (*a*). At one side of the developing device (the side toward which the seal member 6 is to be pulled, this side of the device or the member 6 will be referred to as the "near side"), the seal member 6 as affixed to the device 1 has an edge (lower edge in FIG. 2 (*a*)), i.e. a contour, which is recessed inward (upward in FIG. 2 (*a*)) in an arcuate form unlike the conventional seal member 6' shown in FIG. 2 (*b*). The seal member 6 has two cutouts (tear portions) 6*a*, 6*b* at specified locations. These cutouts 6*a*, 6*b* will be described later.

Figure 3A:
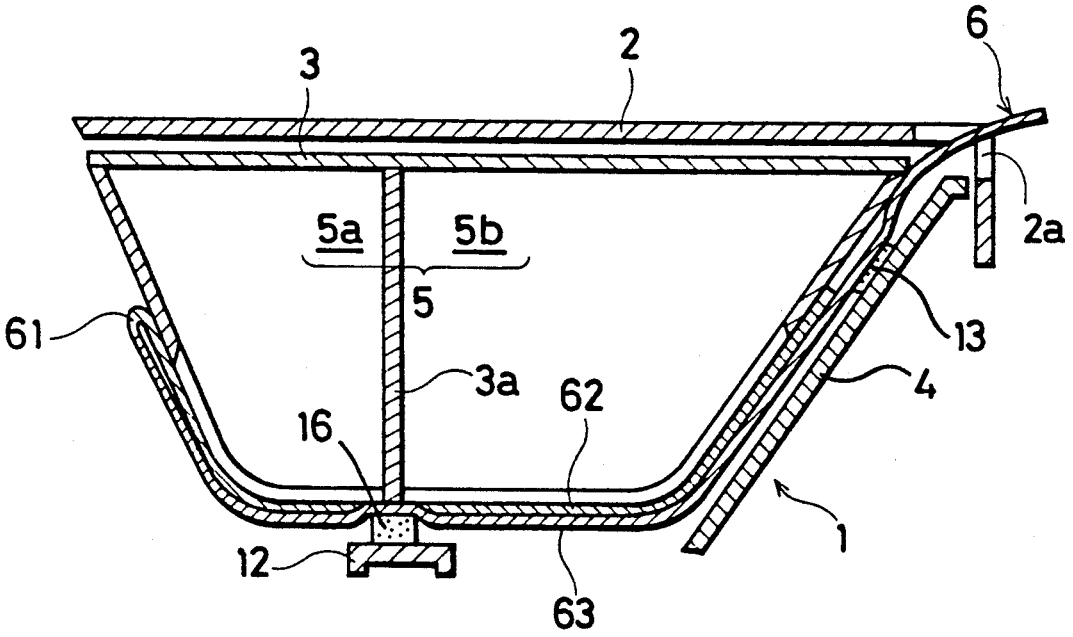
FIG. 3 (*a*) is a sectional view showing the seal structure of the developing device.
Figure 3B:
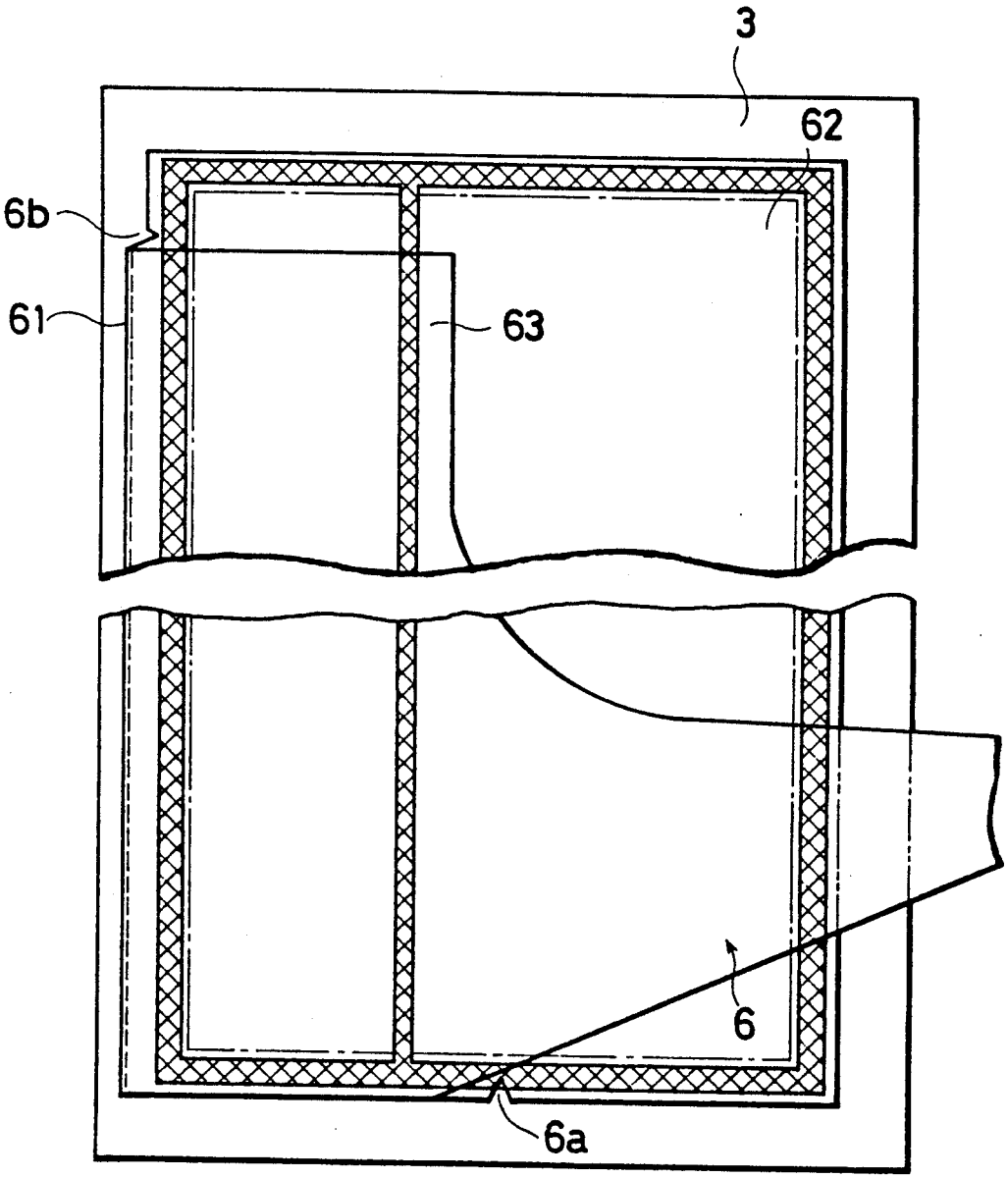

With reference to FIGS. 3 (*a*) and (*b*), the seal member 6 is folded over at an intermediate portion 61 within the developing device 1 and consists of a folded portion 62 and a pull portion (the portion to be pulled) 63. The folded portion 62 is separably adhered (over the mesh-pattern area shown in FIG. 3 (*b*)) to the lower surface of the upper housing 3, whereby the developer chamber 5 is sealed with the unused developer and unused toner contained therein.

On the other hand, the pull portion 63 partly extends outward from the device 1 through a clearance between the upper housing 3 and the lower housing 4 and through an opening 2*a* formed in the UP housing 2. The end of the pull portion 63 is positioned, over the entire width of the seal member, toward the pull side (right side of FIGS. 3 (*a*) and (*b*)) beyond the partition plate 3*a*. The pull portion is held between the lower end of the partition plate 3*a* and a sponge seal 16 provided on the upper side of the partition member 12.

The cutouts 6*a*, 6*b* are formed at specified locations in the remote side (opposite to the near side) edge of the folded portion 62 and an edge portion close to the intermediate portion 61, respectively (lower side edge and left side edge in FIG. 3 (*b*)). The positions of these cutouts are so determined that when pulled, the seal member 6 is torn apart at the cutouts 6*a*, 6*b* to separate a left upper end portion and right lower end portion in FIG. 2 (*a*) from the other portion of the member 6.

Indicated at 13 in FIGS. 1 and 3 (*a*) is a sponge seal for scraping the developer off the seal member 6.

Figure 4:
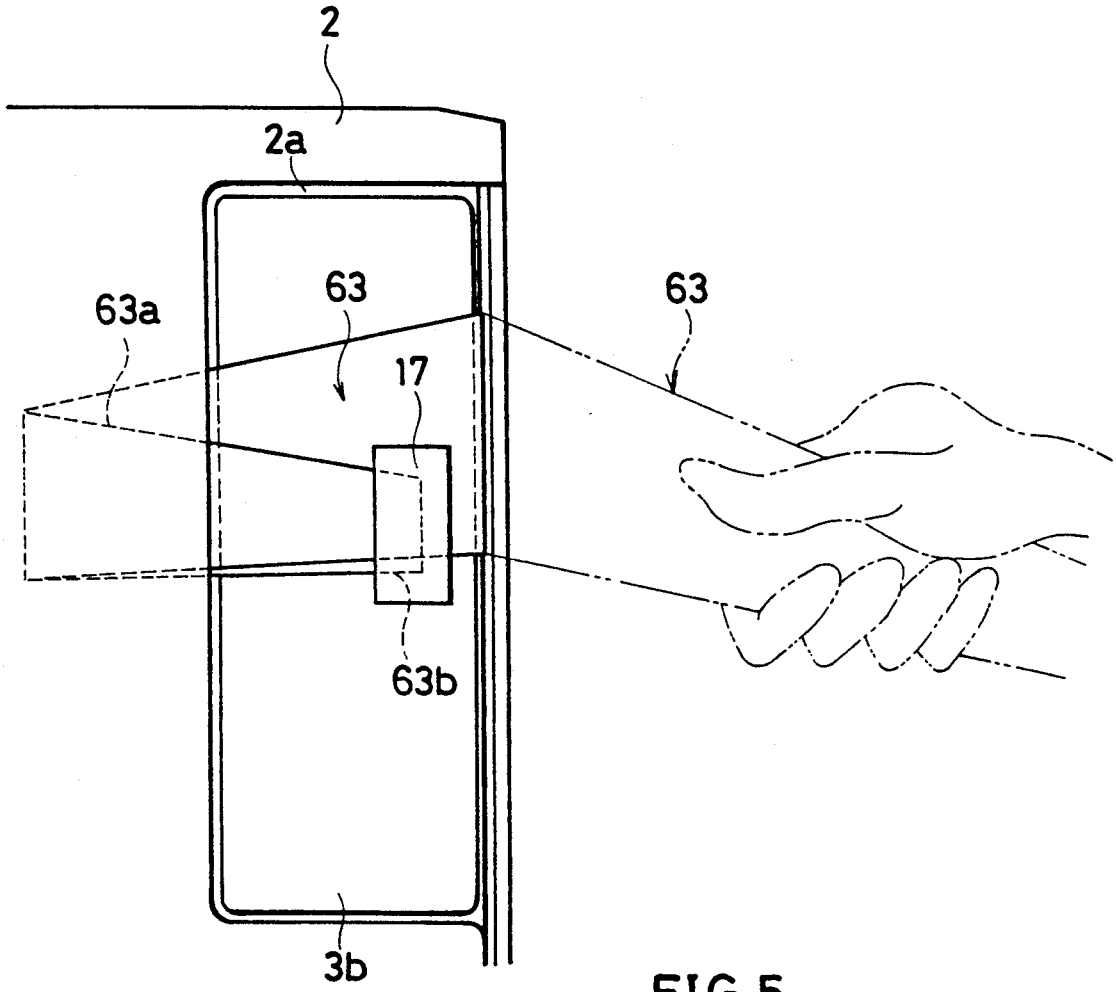
FIG. 4 view showing a pull portion as folded of the seal member of the invention.

As indicated in two-dot-and-dash lines in FIG. 4, the end portion of the pull portion 63 has a length sufficient for the hand to grip this end portion outside the device. As indicated in solid lines in FIG. 4 and as also shown in FIG. 5, the pull portion is fastened to the upper side of the upper housing 3 before the device is used, as folded over at an intermediate part thereof.

Figure 5:
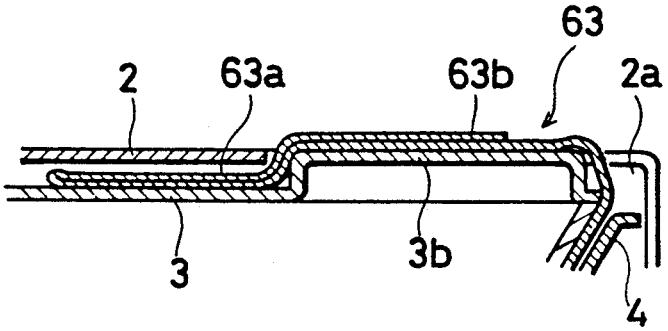
FIG. 5 is a sectional view showing the folded pull portion.

More specifically stated with reference to FIGS. 4 and 5, the upper housing 3 is formed on its upper side with a projection 3*b* which is rectangular in a plan view. The projection 3*b* is exposed from the aforementioned opening 2*a* formed in the upper wall of the PU housing 2. The folded part 63*a* of the pull portion 63 is inserted to a position under the PU housing wall through a clearance between the edge defining the opening 2*a* and the edge of the projection 3*b* opposed thereto (see FIG. 5). Thus, the edge portion defining the opening 2*a* provides a seal holder for holding the folded part 63*a* of the pull portion 63 from above. With the folded part 63*a* thus held in position, the pull portion 63 has it forward end 63*b* secured to the upper surface of the projection 3*b* with a label 17.

Figure 6B:
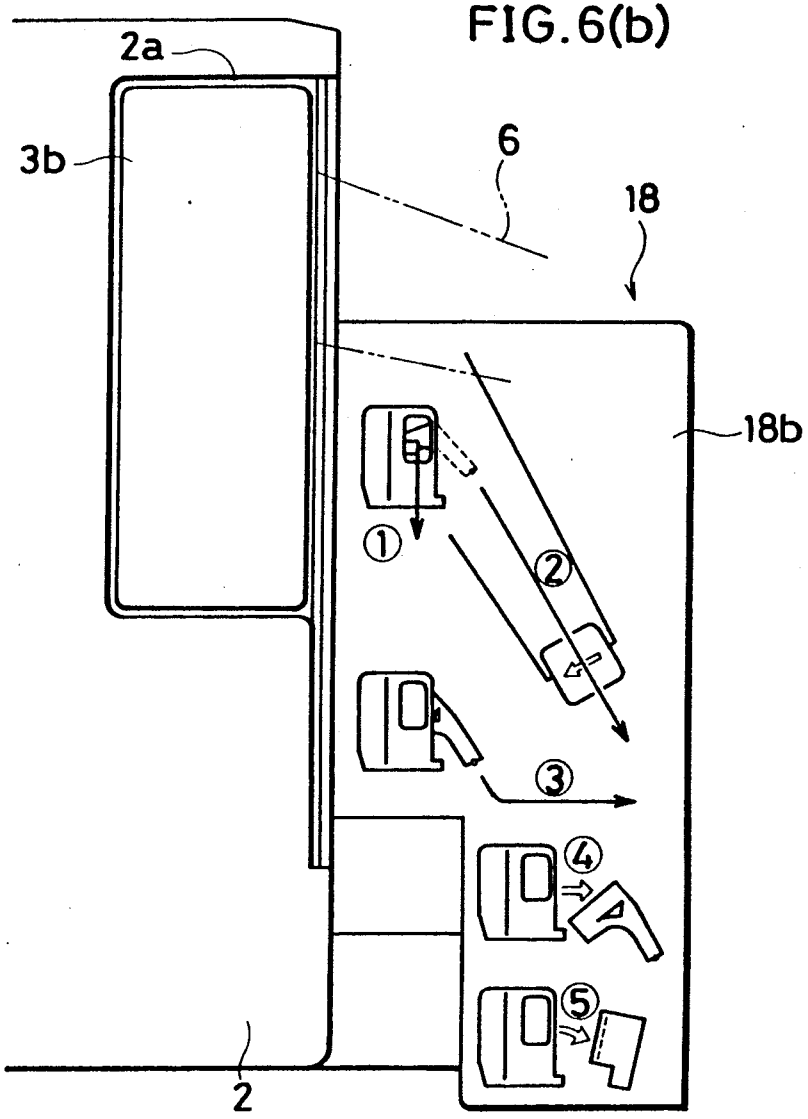
FIGS. 6 (*a*) and (*b*) are plan views showing an instruction sheet provided for the developing device.
Figure 6A:
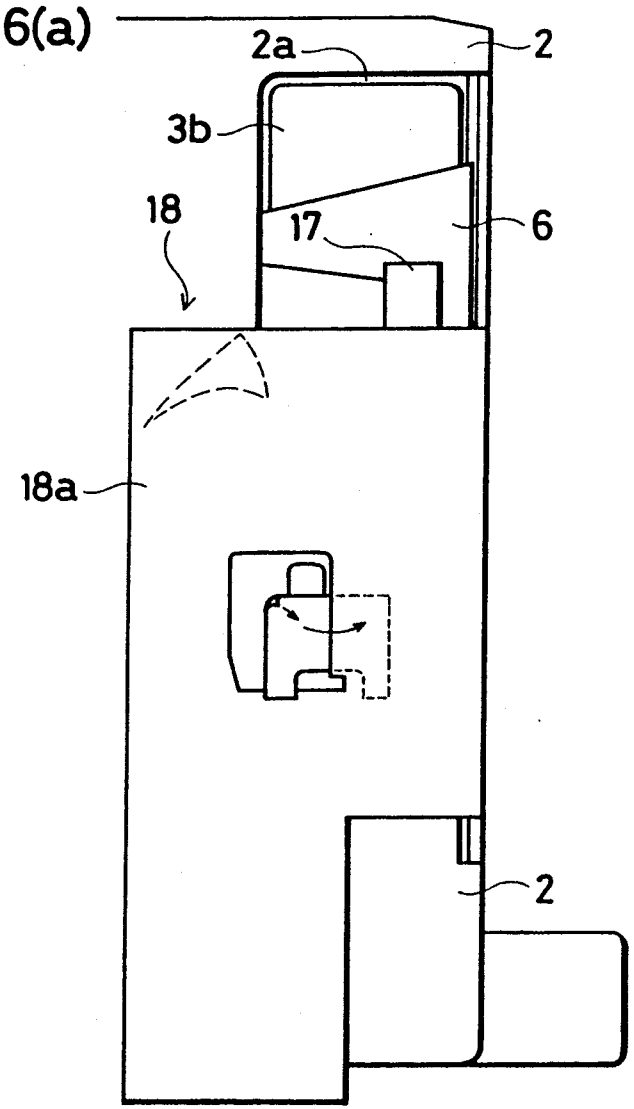

Before use, the developing device 1 is provided with an instruction sheet (member) 18 as seen in FIG. 6 (*a*), (*b*). The instruction sheet 18 has one side portion removably affixed to a side edge portion of the PU housing 2 and the other side portion folded toward the body of the developing device 1 and removably affixed to and covering the upper surface of the PU housing 2 as seen in FIG. 6 (*a*).

The surface 18*a* of the instruction sheet 18 facing upward in the state of FIG. 6 (*a*) bears a diagram instructing the user to peel an edge portion of the sheet 18 off the PU housing 2 and open the sheet rightward. Diagrams illustrating the actual procedure (to be described below) for removing the seal member 6 are given on the other surface 18*b* facing upward when the instruction sheet 18 is opened as seen in FIG. 6 (*b*). These diagrams are positioned generally in coincidence with the actual position of the pull portion 63 of the seal member 6 to be assumed when the seal member is removed.

Figure 7:
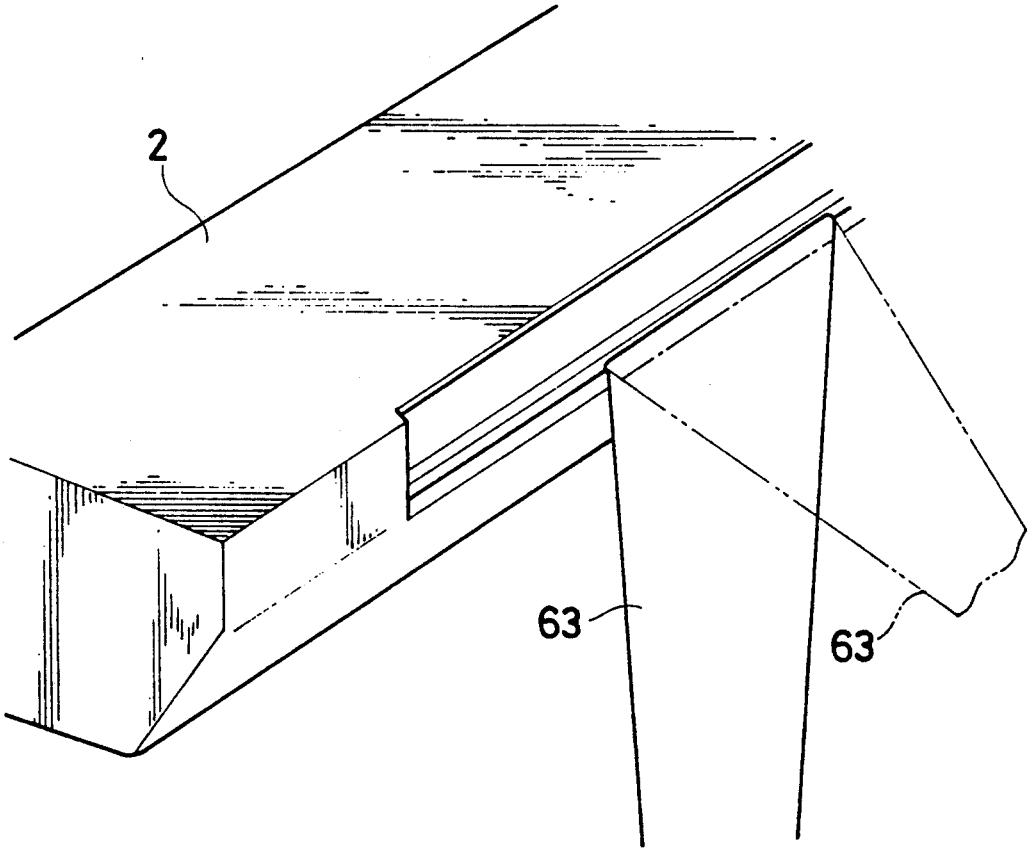
FIG. 7 is a perspective view showing the seal member of the invention while it is being pulled.
Figure 8C:
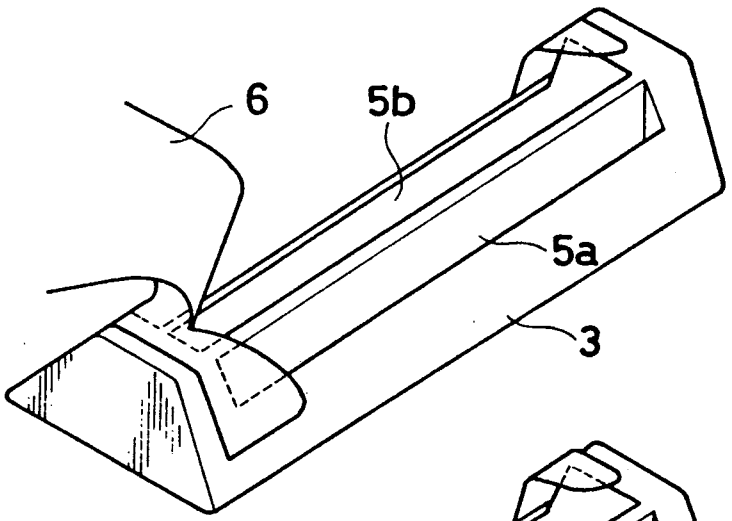
FIGS. 8 (*a*), (*b*), (*c*) and (*d*) are perspective views showing how the seal member of the invention is removed from an upper housing.
Figure 8D:
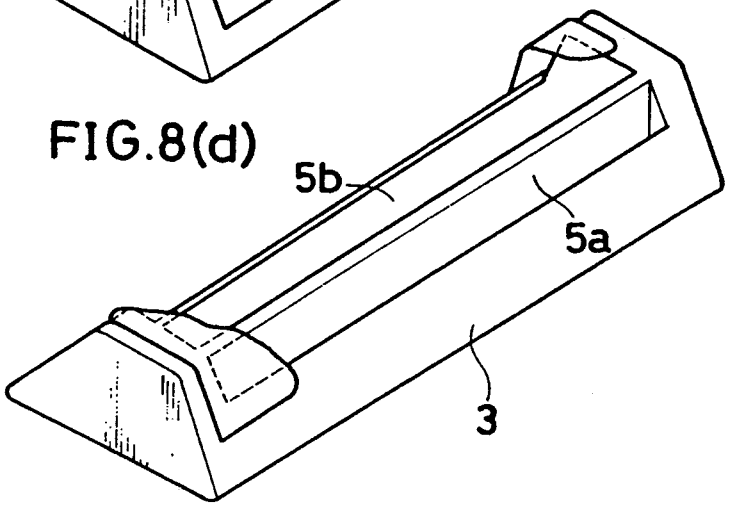
Figure 8A:
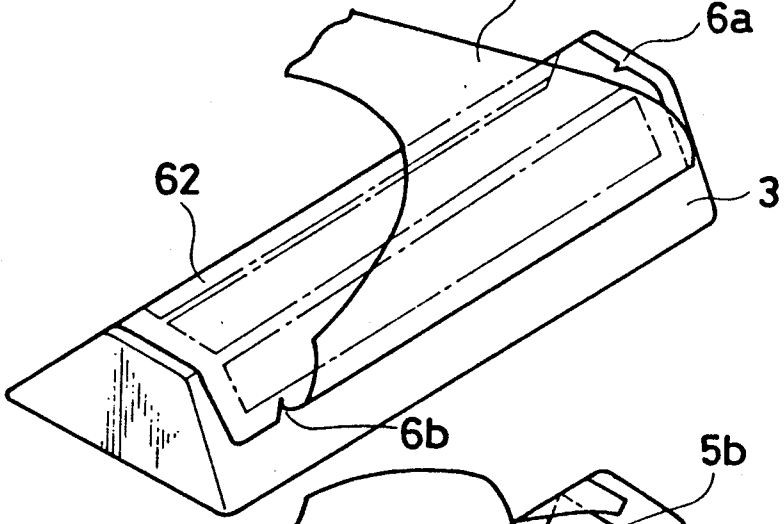
Figure 8B:
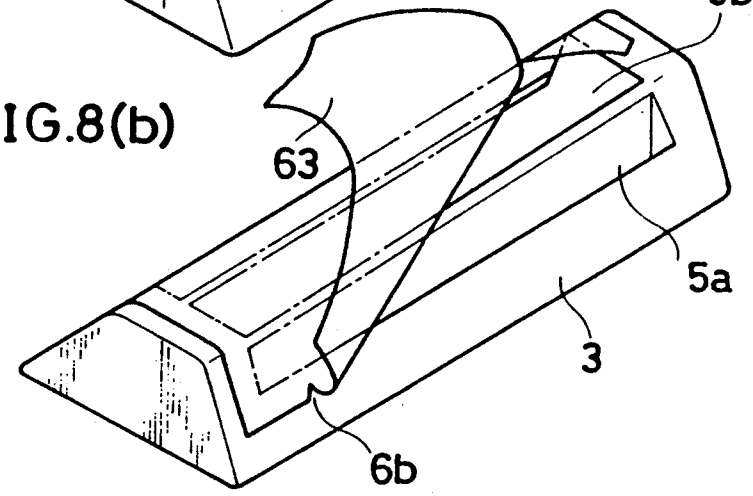

Next, the procedure for removing the seal member 6 will be described with reference to FIGS. 7 and 8 (*a*) to (*d*).

Before use, the developing device 1 is installed as incorporated in the process unit in the body of a copying machine, so that the process unit is withdrawn in its entirety from the machine body. The folded part 63*a* of the pull portion 63 is held by the seal holder and positioned under the upper wall of the upper housing 2. Accordingly, even with the forward end 63*b* being only by the label 17, the pull portion 63 is free of interference with other parts in the copying machine during withdrawal.

With the process unit thus withdrawn from the copying machine, the left-side portion of the instruction sheet 18 affixed to the PU housing 2 (FIG. 6 (*a*)) is peeled off and unfolded rightward to the state of FIG. 6 (*b*) according to the instructions on the front surface 18*a* of the sheet. The seal member 6 is then removed with reference to the diagrams on the other surface 18*b* facing upward in this state.

Figure 9:
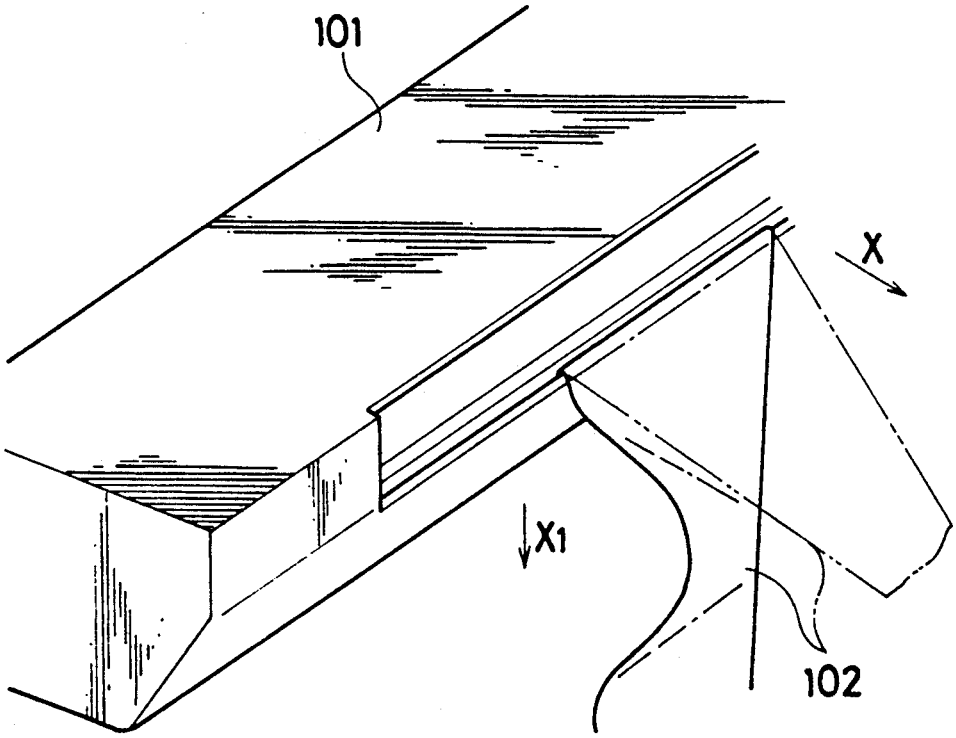
FIG.9 PRIOR ART
FIG. 9 is a perspective view showing the conventional seal member while it is being removed.

First, the label 17 is peeled off generally downward in FIG. 6 (*a*), and the forward end 63*b* of the pull portion 63 is gripped and pulled to draw out the folded part 63*a* from between the PU housing upper wall and the projection 3*a* (see the diagram (1) on the instruction sheet 18). The pull portion 63 is stretched and gripped with the hand (as indicated in the two-dot-and-dash lines in FIG. 4), and then pulled obliquely rightwardly downward in FIGS. 4 and 6 (*b*) (see the diagram (2)). Since the near side edge of the seal member 6 is inwardly recessed as seen in FIG. 2 (*a*), the seal member 6 is less likely to slacken as shown in FIG. 7 even if pulled in the above direction (see also FIG. 9 for comparison).

Subsequently, upon the seal member 6 coming into contact with the side edge positioned toward the pulling direction and defining the opening 2*a* of the PU housing 2, the pull portion 63 is pulled longitudinally of the developing device 1 (see the diagram (3)) to completely remove the seal member 6 (see the diagram (4)). Since the diagrams on the instruction sheet 18 are positioned generally in coincidence with the actual position of the pull portion 63 at all times during the above procedure, the user can remove the seal member easily with reference to the instruction diagrams.

FIGS. 8 (*a*) to (*d*) show how the seal member 6 is removed from the upper housing by the above procedure. For the sake of convenience, the pull portion 63 is illustrated as being released from the upper housing 3 in a free state. However, when to be actually pulled out of the developing device 1, the pull portion 63 is substantially in intimate contact with the folded portion 62 and held between the partition plate 3*a* and the sponge seal 16, with its end positioned, over the entire width of the member 6, toward the pull side beyond the partition plate 3*a*. Accordingly, there is no likelihood of the pull portion end being caught by the developer scraper 15, the partition plate 3*a*, sponge seal 16 or the like.

With reference to FIGS. 8 (*a*) to (*d*), the seal member 6 is progressively separated off first at the right lower corner thereof shown in FIG. 8 (*a*) when pulled in the above-mentioned direction. When the seal member has been separated off to the position of the cutout 6*a*, a tear develops from the cutout 6*a* to leave the right upper end portion on the upper housing 3 as shown in FIG. 8 (*b*), permitting the other portion only to be pulled out from the device. When the seal member has been separated off to the position of the cutout 6*b*, a tear develops also from the cutout 6*b* (FIG. 8 (*c*)). Eventually, the right upper end portion and the left lower end portion remain on the housing 3, and the other portion is entirely removed as shown in FIG. 8 (*d*). These remaining end portions are remotest from the center of pull on the seal member 6 toward the opposite sides thereof, least likely to be subjected to the tensile force and therefore inherently most prone to crease. With the end portions separated off and remaining on the upper housing 3, it is possible to prevent the developer from being carried out as held between creases and spilling from the device.

With the seal member 6 thus removed, the developer chamber 5 communicates with the space thereunder, permitting the unused developer (starting developer) to fall into a space portion on the left side of the replenishing roller 8 in FIG. 1 and the unused toner to fall into a space portion on the right side of the roller 8. The instruction sheet 18 is then peeled off the PU housing 2 (see the diagram (5) on the sheet 18), and the process unit including the developing device 1 is set in the copying machine again to render the device ready for use. The developer and toner remaining on the remaining end portions of the seal member 6 are caused to fall into the respective space portions therebelow by the impact produced upon setting the unit.

In addition to the foregoing embodiment, the the present invention can be practiced for example, in the form of the following modifications.

(1) Although the above embodiment has two cutouts 6*a*, 6*b* to separate the two end portions positioned inside the developing device 1 from the other portion, only one cutout may be formed insofar as it is possible to separate off the end portion which is most prone to crease. The tear portion is not limited to such a cutout, but the same advantage as above can be obtained, for example, when it is in the form of an incision, perforations or the like.

(2) The contour of the seal member 6 at the near side thereof is arcuate with the foregoing embodiment but may be curved otherwise or comprise a plurality of straight lines insofar as the seal member can be prevented from slackening when pulled.

(3) With the above embodiment, the projection 3*b* is formed on the upper side of the upper housing 3 of the developing device 1 incorporated in the process unit, in combination with the seal holder provided by the upper wall of the PU housing 2, whereas some other seal holding means is usable provided that the folded part 63*a* of the pull portion 63 can be inserted. For example, in the case where the developing device 1 is independent of the process unit instead of being incorporated therein or is joined to the process unit, the same effect as above can be achieved by a groove or the like formed in the outer surface of the developing device 1 or of the unit.

(4) Although the foregoing embodiment is used for the developing device 1 for use with two-component developer, the seal structures defined in the appended claims other than claim 18 are also usable for developing devices adapted for use with a single-component developer and having a single developer chamber or compartment only. These structures are usable similarly also for developing devices adapted for use with a two-component developer and having a toner compartment only.

(5) The above embodiment is designed for the developing device 1 fixedly having the developer chamber 15 therein. However, the seal structures as defined in the appended claims other than claims 4 and 18 are usable also for a developing device having a developer chamber in the form of a cartridge which is removably attached to the body of the device. In this case, the cartridge is attached to the device body with a cartridge opening closed with the seal member, and the seal member is thereafter removed from outside the device.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A seal structure for a developing device having a developer chamber, the seal structure including a seal member for sealing the developer chamber with an unused developer accommodated therein, the seal member partly extending outward from the developing device to provide a pull portion and being removable from the developing device by pulling the pull portion, the seal structure being characterized in that the seal member is folded over at an intermediate portion thereof to form a folded portion over the pull portion, the folded portion being secured to the body of the developing device and formed in an edge thereof with a tear portion for separating the seal member into an end portion positioned inside the developing device and the other portion when the seal member is pulled.

2. A seal structure as defined in claim 1 wherein the tear portion is a cutout.

3. A seal structure as defined in claim 1 wherein the tear portion is an incision.

4. A seal structure as defined in claim 1 wherein the tear portion is perforated.

5. A seal structure as defined in claim 1 wherein the tear portion is formed in the remote side edge of the folded portion.

6. A seal structure as defined in claim 1 wherein the tear portion is positioned close to the intermediate portion of the seal member.

7. A seal structure for a developing device having a developer chamber, the seal structure including a seal member for sealing the developer chamber with an unused developer accommodated therein, the seal member partly extending outward from the developing device to provide a pull portion and being removable from the developing device by pulling the pull portion, the seal structure being characterized in that the body of the developing device is externally provided with a seal holder permitting insertion of the seal member, the pull portion of the seal member being folded over at an intermediate part thereof and having the folded part inserted in the seal holder, the pull portion having a forward end secured to an outer portion of the developing device.

8. A seal structure as defined in claim 7 wherein the seal holder is provided by an edge defining an opening formed in the housing of a process unit including the developing device.

9. A seal structure as defined in claim 7 wherein the seal holder has a groove formed in the outer surface of a process unit including the developing device.

10. A seal structure as defined in claim 7 wherein the seal holder has a groove formed in the outer surface of the developing device.

11. A seal structure for a developing device having a developer chamber, the seal structure including a seal member for sealing the developer chamber with an unused developer accommodated therein, the seal member partly extending outward from the developing device to provide a pull portion and being removable from the developing device by pulling the pull portion, the seal structure being characterized in that the pull portion has an inwardly recessed contour extending from the outer end thereof to at least one side edge of the seal member.

12. A seal structure as defined in claim 11 wherein the contour is a curve.

13. A structure as defined in claim 12 wherein the contour is arcuate.

14. A seal structure as defined in claim 11 wherein the contour is formed by a plurality of straight lines.

15. A seal structure for a chamber means containing a developer material, comprising a seal member for sealing said chamber means with said developer material accommodated therein, said seal member having a pull portion and being removable from said chamber means by pulling said pull portion, said seal member being folded over at an intermediate portion thereof to form a folded portion over said pull portion, said folded portion being secured to said chamber means and formed having an edge formed with a tear means for separating said seal member into an end portion remaining attached to said chamber means and another portion which is pulled off of said chamber means and which is separated from said end portion when said pull portion is pulled off of said chamber means.

16. A seal structure as defined in claim 15, wherein said chamber means comprises a developing device.

17. A seal structure as defined in claim 15, wherein said chamber means comprises a cartridge.

18. A seal structure for a chamber means containing a developer material, comprising a seal member for sealing said chamber means with developer material accommodated therein, said seal member having a pull portion and being removable from said chamber means by pulling said pull portion, said pull portion of said seal member being folded over at an intermediate part thereof to form a folded part, said chamber means being externally provided with a seal holder means, said folded part being inserted in said seal holder means.

19. A seal structure according to claim 18, wherein said pull portion has a forward end, and securing means securing said forward end to said chamber means.

20. A seal structure according to claim 18, wherein said pull portion has a forward end, and securing means securing said forward end to said folded part.

21. A seal structure according to claim 20, wherein said chamber means comprises a developing device.

22. A seal structure according to claim 20, wherein said chamber means comprises a cartridge.

23. A seal structure for a chamber means containing a developer material, comprising a seal member for sealing said chamber means with said developer material accommodated therein, said seal member having a pull portion and being removable from said chamber means by pulling said pull portion, said pull portion having an inwardly recessed contour extending from the outer end of said pull portion to one side edge of said seal member.

24. A seal structure according to claim 23, wherein said chamber means comprises a developing device.

25. A seal structure according to claim 23, wherein said chamber means comprises a cartridge.

26. A seal structure for a chamber means containing a developer material comprising a seal member for sealing said developer material within said chamber means, said seal member having a pull portion, said seal member being removable from said chamber means by pulling said pull portion, a sheet material means having indicia means representing instructions for pulling said seal member from said chamber means, said sheet material means being disposed on said chamber means to positionally correlate said indicia means with said pull portion so that a user readily recognizes the desired pulling direction of said pull portion.

27. A seal structure according to claim 26, wherein said sheet material means underlies said pull portion as said pull portion is pulled out from said chamber means.

28. A seal structure according to claim 26, wherein said chamber means has an end wall juxtaposed to said pull portion, said sheet material means extending outwardly beyond said end wall to underlie said pull portion as said pull portion is pulled out of said chamber means.

29. A seal structure according to claim 26, wherein said sheet material means has a front face and a back face, said indicia means being on said front face, said sheet material means having an initial position and an operable position, said sheet material means being disposed with said front face up when in said operable position, said sheet material means when in said operable position underlying said pull portion as said pull portion is being pulled from said chamber means, said sheet material means being disposed on said chamber means with said back face up when in said initial position.

30. A seal structure according to claim 29, wherein said sheet material means is peelable from said chamber means when in said initial position and then manually movable to said operable position when said seal member is about to be pulled from said chamber means.

31. A seal structure according to claim 30 further comprising indicia means on said back face of said sheet material means representing instructions for peeling and moving said sheet material means from said initial position to said operable position.

32. A seal structure according to claim 26, wherein said chamber means comprises a developing device.

33. A seal structure according to claim 26, wherein said chamber means comprises a cartridge.

34. A seal structure for a chamber means having a developer compartment for a developer material and a toner compartment for a toner, boundary means separating said developer compartment from said toner compartment, a seal member having a seal portion and a pull portion, said seal member having a fold intermediate said seal portion and said pull portion with said pull portion underlying said seal portion, said seal portion underlying said two compartments and said boundary means and sealing said developer and toner in said two compartments, said pull portion having a first section juxtaposed to said fold and a leading section extending from said first section, said first section underlying one of said compartments and also underlying said boundary means, said leading section underlying at least a part of said other compartment, said leading section having a narrow width to enable said leading section to be grasped by a person's hand to effect removal of the seal member by pulling in a pulling direction in which the fold moves along said one compartment towards said boundary means and then past said boundary means, said leading section having a width less than the width of said seal portion and less than the width of said first section.

35. A seal structure for a chamber means according to claim 34, wherein said boundary means comprises a boundary wall between said two compartments, said boundary wall having a lower terminating end, and further comprising a seal means underlying said terminating end of said boundary wall, said seal member being disposed between said terminating end of said boundary wall and said seal means.

36. A seal structure for a chamber means according to claim 27, wherein said seal portion of said seal member is sealed to said terminating end of said boundary wall.

37. A seal structure for a chamber means according to claim 28, wherein said seal means comprises a resilient seal member.

38. A seal structure according to claim 34, wherein said chambers means comprises a developing device.

39. A seal structure according to claim 34, wherein said chamber means comprises a cartridge.

* * * * *